US008304029B2

(12) United States Patent
Brisberger et al.

(10) Patent No.: US 8,304,029 B2
(45) Date of Patent: Nov. 6, 2012

(54) METHOD AND DEVICE FOR HOT-DIP COATING A METAL STRAND

(75) Inventors: Rolf Brisberger, Issum (DE); Bernhard Tenckhoff, Duisburg (DE); Holger Behrens, Erkrath (DE); Bodo Falkenhahn, Ratingen (DE); Walter Trakowski, Duisburg (DE); Michael Zielenbach, Siegen (DE); Robert Jürgens, Remscheid (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 606 days.

(21) Appl. No.: 10/536,871

(22) PCT Filed: Nov. 15, 2003

(86) PCT No.: PCT/EP03/12791

§ 371 (c)(1),
(2), (4) Date: Feb. 16, 2006

(87) PCT Pub. No.: WO2004/050941

PCT Pub. Date: Jun. 17, 2004

(65) Prior Publication Data

US 2007/0166476 A1 Jul. 19, 2007

(30) Foreign Application Priority Data

Nov. 30, 2002 (DE) ..... 102 55 995

(51) Int. Cl.
*B05D 1/18* (2006.01)
*B05C 3/02* (2006.01)

(52) U.S. Cl. ..... 427/436; 427/435; 427/433; 427/8; 118/419; 118/405

(58) Field of Classification Search ..... 427/8–10, 427/431, 434.2, 434.6, 434.7
See application file for complete search history.

(56) References Cited

U.S. PATENT DOCUMENTS 4,912,407 A * 3/1990 Gualtieri et al. ..... 324/204
(Continued)

FOREIGN PATENT DOCUMENTS

DE 195 35 854 3/1997
(Continued)

OTHER PUBLICATIONS

Machine Translation of JP10298727.* Hitz et al. True Position Measurement with Eddy Current Technology. Sensors Magazine. Nov. 1, 1997, retrieved online www.sensormag.com on May 20, 2010.*

(Continued)

*Primary Examiner* — David Turocy
(74) *Attorney, Agent, or Firm* — Lucas & Mercanti, LLP; Klaus P. Stoffel

(57) ABSTRACT

The invention relates to a device for hot-dip coating a metal strand (1), especially a steel strip, in which the metal strand (1) is vertically guided through a container (3) accommodating the molten coating metal (2) and through a guide channel (4) disposed upstream thereof. The inventive device comprises at least two inductors (5) disposed at both sides of the metal strand (1) in the area of the guide channel (4) that are used to generate an electromagnetic field for retaining the coating metal (2) in the container (3), and at least one sensor (6, 6') for detecting the position (s) of the metal strand (1) in the area of the guide channel (4). In order to simplify and render more precise the detection of the position of the metal strand in the guide channel, the sensor for detecting the position of the metal strand (1) consists of two coils (6, 6') that are disposed, when seen from the direction of conveyance (R) of the metal strand (1), within the height ($H_0$) of the inductors (5) between the inductors (5) and the metal strand (1). The invention further relates to a method for hot-dip coating a metal strand.

8 Claims, 1 Drawing Sheet

U.S. PATENT DOCUMENTS

| | | | | |
|---|---|---|---|---|
| 6,194,022 | B1 * | 2/2001 | Schunk | 427/8 |
| 6,471,153 | B1 * | 10/2002 | Kimura et al. | 242/419.3 |
| 7,361,224 | B2 * | 4/2008 | Trakowski et al. | 118/405 |

FOREIGN PATENT DOCUMENTS

| | | | | |
|---|---|---|---|---|
| DE | 100 14 867 | | | 9/2001 |
| EP | 0 673 444 | | | 12/1996 |
| JP | 06108220 | A | * | 4/1994 |
| JP | 10110251 | A | * | 4/1998 |
| JP | 10298727 | A | * | 11/1998 |
| WO | 96 03533 | | | 2/1996 |
| WO | 01/11101 | | | 2/2001 |
| WO | WO 0171051 | A1 | * | 9/2001 |
| WO | 02/14572 | | | 2/2002 |
| WO | WO 03076680 | A1 | * | 9/2003 |

OTHER PUBLICATIONS

Patent Abstracts of Japan, vol. 1998, No. 6, Apr. 30, 1998 & JP 10 046310 A (Nisshin Steel Co Ltd), Feb. 17, 1998.

Patent Abstracts of Japan, vol. 1998, No. 9, Jul. 31, 1998 & JP 10 110251 A (Shinko Electric Co Ltd), Apr. 28, 1998.

Patent Abstracts of Japan, vol. 0184, No. 48, Aug. 22, 1994 & JP 6 136502 1 (Nisshin Steel Co Ltd), May 17, 1994.

Patent Abstracts of Japan, vol. 0184, No. 92, Jul. 22, 1994 & JP 6 108220 A (Nisshin Steel Co Ltd), Apr. 19, 1994.

Patent Abstracts of Japan & JP 5 086 446 (Nippon Konan KK), Apr. 6, 1993.

Patent Abstracts of Japan & JP 102 98 727 (Nippon Konan KR), Nov. 10, 1998.

* cited by examiner

METHOD AND DEVICE FOR HOT-DIP COATING A METAL STRAND

The invention concerns a device for hot dip coating a metal strand, especially a steel strip, in which the metal strand is passed vertically through a coating tank that contains the molten coating metal and through a guide channel upstream of the coating tank, with at least two inductors installed on both sides of the metal strand in the area of the guide channel for generating an electromagnetic field in order to keep the coating metal in the coating tank and with at least one sensor for determining the position of the metal strand in the area of the guide channel. The invention also concerns a method for hot dip coating a metal strand.

Conventional metal hot dip coating installations for metal strip have a high-maintenance part, namely, the coating tank and the fittings it contains. Before being coated, the surfaces of the metal strip must be cleaned of oxide residues and activated for bonding with the coating metal. For this reason, the strip surfaces are subjected to heat treatments in a reducing atmosphere before the coating operation is carried out. Since the oxide coatings are first removed by chemical or abrasive methods, the reducing heat treatment process activates the surfaces, so that after the heat treatment, they are present in a pure metallic state.

However, this activation of the strip surfaces increases their affinity for the surrounding atmospheric oxygen. To prevent the surface of the strip from being reexposed to atmospheric oxygen before the coating process, the strip is introduced into the hot dip coating bath from above in an immersion snout. Since the coating metal is present in the molten state, and since one would like to utilize gravity together with blowing devices to adjust the coating thickness, but the subsequent processes prohibit strip contact until the coating metal has completely solidified, the strip must be deflected in the vertical direction in the coating tank. This is accomplished with a roller that runs in the molten metal. This roller is subject to strong wear by the molten coating metal and is the cause of shutdowns and thus loss of production.

The desired low coating thicknesses of the coating metal, which vary in the micrometer range, place high demands on the quality of the strip surface. This means that the surfaces of the strip-guiding rollers must also be of high quality. Problems with these surfaces generally lead to defects in the surface of the strip. This is a further cause of frequent plant shutdowns.

To avoid the problems associated with rollers running in the molten coating metal, approaches have been proposed, in which a coating tank is used that is open at the bottom and has a guide channel in its lower section for guiding the strip vertically upward, and in which an electromagnetic seal is used to seal the open bottom of the coating tank. The production of the electromagnetic seal involves the use of electromagnetic inductors, which operate with electromagnetic alternating or traveling fields that seal the coating tank at the bottom by means of a repelling, pumping or constricting effect.

A solution of this type is described, for example, in EP 0 673 444 B1. The solution described in WO 96/03,533 and the solution described in JP 50[1975]-86,446 also provide for an electromagnetic seal for sealing the coating tank at the bottom.

Although this allows the coating of nonferromagnetic metal strip, problems arise in the coating of steel strip, which is essentially ferromagnetic, because the ferromagnetism causes the strip to be drawn to the walls of the channel in the electromagnetic seals, and this damages the surface of the strip. Another problem that arises is that the coating metal and the metal strip itself are unacceptably heated by the inductive fields.

An unstable equilibrium exists with respect to the position of the ferromagnetic steel strip passing through the guide channel between two traveling-field inductors. The sum of the forces of magnetic attraction acting on the strip is zero only in the center of the guide channel. As soon as the steel strip is deflected from its center position, it draws closer to one of the two inductors and moves farther away from the other inductor. The reasons for this type of deflection may be simple flatness defects of the strip. Defects of this type include any type of strip waviness in the direction of strip flow, viewed over the width of the strip (center buckles, quarter buckles, edge waviness, flutter, twist, crossbow, S-shape, etc.). The magnetic induction, which is responsible for the magnetic attraction, decreases in field strength with increasing distance from the inductor according to an exponential function. Therefore, the force of attraction similarly decreases with the square of the induction field strength as the distance from the inductor increases. This means that when the strip is deflected in one direction, the force of attraction to one inductor increases exponentially, while the restoring force by the other inductor decreases exponentially. Both effects intensify by themselves, so that the equilibrium is unstable.

DE 195 35 854 A1 and DE 100 14 867 A1 offer approaches to the solution of this problem, i.e., the problem of more precise position control of the metal strand in the guide channel. According to the concepts disclosed there, the coils for inducing the electromagnetic traveling field are supplemented by additional coils, which are connected to an automatic control system and see to it that when the metal strip deviates from its center position, it is brought back into this position.

An important prerequisite for automatically controlling the position of the metal strand in the guide channel is the exact determination of the position. WO 01/11,101, JP 10[1998]-298,727 and JP 10[1998]-046,310 disclose sensors for this purpose without specifying their specific design and exact arrangement.

Therefore, the objective of the invention is to specify a sensor for a device of this general type, which determines the position of the metal strand in the guide channel and is characterized by a high degree of measuring accuracy, a simple design, and inexpensive manufacture. This is intended to increase the efficiency of the automatic control of the metal strand in the center plane of the guide channel.

The solution to this problem in accordance with the invention is characterized by the fact that the sensor for determining the position of the metal strand consists of two coils, which are installed, as viewed in the direction of conveyance of the metal strand, within the height of the inductors and between the inductors and the metal strand.

In this regard, the coils and the inductors are preferably arranged symmetrically with respect to the center plane of the guide channel.

The coils are preferably the same and are designed as wire windings without a core. They can have one or more windings. It is advantageous for the wire used in the coils to consist of copper. Furthermore, the windings of the coils can have a circular, oval, or rectangular shape.

In accordance with a modification, the coils are connected to a measuring device for measuring the voltage induced in the coils. In this regard, it can be provided that the measuring device is designed for high-impedance measurement of the voltages induced in the coils.

In addition, the measuring device can have a subtractor, with which the difference of the two voltages induced in the coils can be determined.

Finally, it can be provided that several pairs of coils are installed, as viewed in the direction of conveyance of the metal strand, within the height of the inductors and between the inductors and the metal strand.

In the method of the invention for hot dip coating a metal strand, the metal strand is passed vertically through the tank that contains the coating metal and through the guide channel, which is positioned upstream of the coating tank. To keep the coating metal in the coating tank, at least two inductors are installed on both sides of the metal strand in the area of the guide channel. At least one sensor is used to determine the position of the metal strand in the area of the guide channel.

In accordance with the method of the invention, two coils are used to determine the position of the metal strand. The two coils are installed, as viewed in the direction of conveyance of the metal strand, within the height of the inductors and between the inductors and the metal strand. The voltages induced in the coils are measured, the difference between the measured voltages is taken, and the resulting value is used to derive an indicator for the position of the metal strand. Thus, after the two induction voltages have been measured, one is subtracted from the other. Depending on the determined difference, a conclusion is drawn about the magnitude of the deviation of the metal strand from the center position.

The proposed sensor for determining the position of the metal strand in the guide channel is characterized by a simple and thus inexpensive design. Moreover, it allows very exact determination of the position of the strand.

An embodiment of the invention is illustrated in the drawings.

Figure 2:
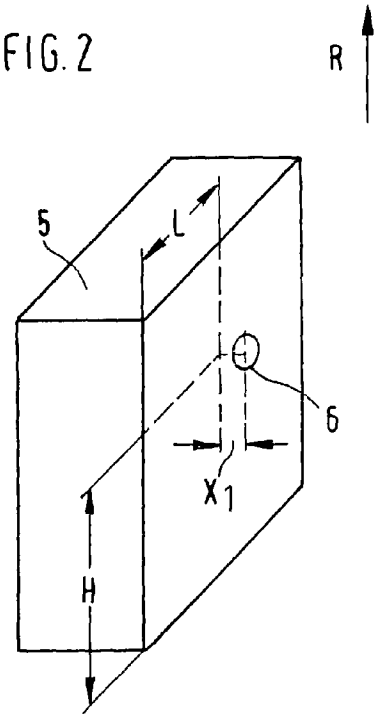
FIG. 2 shows a perspective view of an inductor with a measuring coil arranged in front of it.

The hot dip coating installation has a coating tank 3, which is filled with molten coating metal 2. The molten coating metal can be, for example, zinc or aluminum. The metal strand 1 to be coated is in the form of a steel strip. It passes vertically upward through the coating tank 3 in conveying direction R. It should be noted at this point that it is also basically possible for the metal strand 1 to pass through the coating tank 3 from top to bottom. To allow passage of the metal strand 1 through the coating tank 3, the latter is open at the bottom, where a guide channel 4 is located. The guide channel 4 is drawn exaggeratedly large or broad.

To prevent the molten coating metal 2 from flowing out at the bottom through the guide channel 4, two electromagnetic inductors 5 are located on either side of the metal strand 1. The electromagnetic inductors 5 generate a magnetic field, which produces lifting forces in the liquid coating metal 2, and these forces counteract the weight of the coating metal 2 and thus seal the guide channel 4 at the bottom.

The inductors 5 are two alternating-field or traveling-field inductors installed opposite each other. They are operated in a frequency range of 2 Hz to 10 kHz and create an electromagnetic transverse field perpendicular to the conveying direction R. The preferred frequency range for single-phase systems (alternating-field inductors) is 2 kHz to 10 kHz, and the preferred frequency range for polyphase systems (e.g., traveling-field inductors) is 2 Hz to 2 kHz.

The goal is to hold the metal strand 1, which is located in the guide channel 4, in such a way that it lies in a position that is as well defined as possible, preferably in the center plane 7 of the guide channel 4.

The metal strand 1 between the two opposing inductors 5 is generally drawn towards the closer inductor when an electromagnetic field is created between the inductors 5, and the attraction increases the closer the metal strand 1 approaches the inductor, which leads to an extremely unstable strip center position. During the operation of the installation, this results in the problem that the metal strand 1 cannot run freely and centrally through the guide channel 4 between the activated inductors 5 due to the force of attraction of the inductors.

Therefore, to stabilize the metal strand 1 in the center plane 7 of the guide channel 4, a closed-loop control system (not shown) is provided, which makes it possible to affect the position of the metal strand 1 by means of supplementary electromagnetic coils (also not shown). The superposition of the magnetic fields of the inductors 5 and the supplementary coils (not shown) ensures that the metal strand 1 maintains a well-defined, preferably central, position. In this regard, depending on their degree of activation, the supplementary coils can strengthen or weaken the magnetic field of the inductors 5 (superposition principle).

The two inductors 5 are arranged essentially with reflective symmetry relative to the center plane 7 of the guide channel and are separated from each other by a distance Y. The height $H_0$ of the inductors, as viewed in the conveying direction R of the metal strand 1, is the same for both inductors 5.

Figure 1:
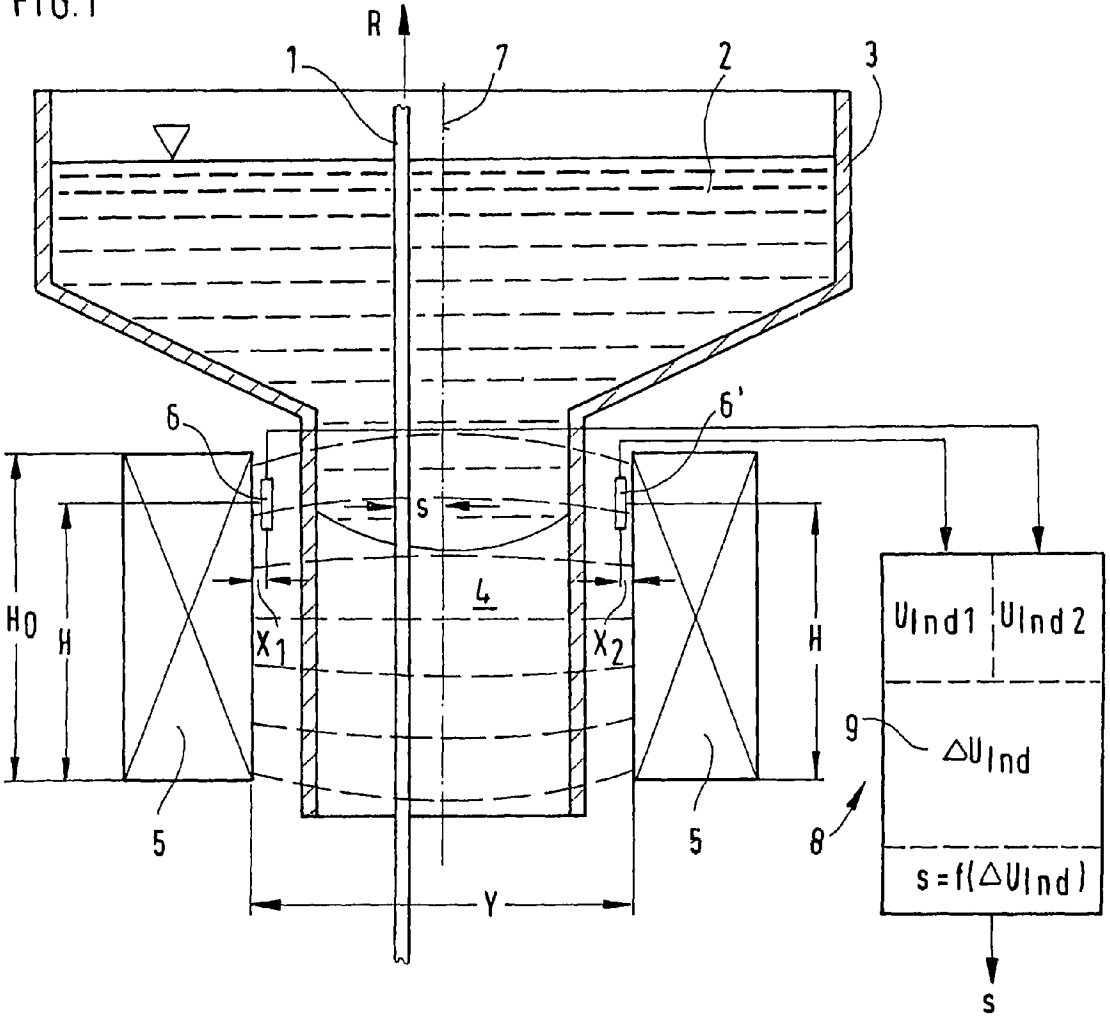
FIG. 1 shows a schematic section through a hot dip coating installation with a metal strand being guided through it.

Two coils 6 and 6' are arranged with reflective symmetry to the center plane 7 between the inductors 5 and the metal strand 1, specifically between the inductors 5 and the wall of the guide channel 4. FIG. 1 shows their height position H and their distance $X_1$ and $X_2$ from the inductor 5. Moreover, as FIG. 2 shows in a perspective view of an inductor 5 with a coil 6 arranged in front of it, coil 6 is also arranged in a well-defined width position L relative to the inductor 5.

For efficient automatic control, it is essential to determine the position s of the metal strand 1 in the guide channel, i.e., the deviation from the center plane 7, as accurately as possible.

The position measurement sensors (coils) 6 and 6', which are designed as wire windings without a core, are used for this purpose. They are arranged in front of the corresponding inductors 5 in the electromagnetic field and are suitable for measurement of a voltage $U_{Ind1}$ and $U_{Ind2}$ induced in the coils 6, 6'. This voltage is proportional to the generated field strength in the inductors 5. The voltage induced in the coils 6, 6' is measured without current (with high impedance) so as not to affect the field of the inductors 5 (and possibly the supplementary coils). The coils 6, 6' have one or more windings of a conductive wire metal (e.g., copper wire). The coils 6, 6' are produced by winding the wire material in a circular, oval, rectangular or similar shape around a center.

As FIG. 1 shows, two coils 6, 6' (only one pair of coils is shown) are arranged relative to each other in the electromagnetic field of the inductors 5 in such a way that they form a geometrically opposed pair. In this regard, the coils 6, 6' of a matched pair are each arranged between the inductor 5 and the steel strip 1. They are arranged with reflective symmetry relative to the center plane 7 of the guide channel 4, i.e., the height position H of the coils 6, 6', the width position L of the coils 6, 6' (see FIG. 2), and the distance $X_1$ and $X_2$ of the coils 6, 6' from the inductor 5 are the same. It should be noted that equality of the distances $X_1$ and $X_2$ is not a necessary condition.

If the metal strand 1 is located between the inductors 5 and thus between the coils 6, 6' in the given electromagnetic field, the measured induced voltage in the coils 6, 6' varies according to the position s of the metal strand 1. This is due to the feedback of the metal strand 1 in the magnetic field. The proposed concept is thus aimed at the combination of the arrangement of the inductors and the position of the measuring coils within the magnetic field, in which the effect of the interaction of the metal strand 1 with the magnetic field of the electromagnetic seal is utilized.

The utilized effect is explained on the basis of the following physical considerations:

The following voltage is induced in the coils 6, 6' according to the well-known principle of electromagnetic induction:

$$U_{Ind}=-n\cdot dPhi/dt$$

where $U_{Ind}$: induced voltage in the coil n: number of windings of the coil dPhi=B·dA: magnetic flux density, where A: area of the coil perpendicular to the magnetic field B: magnetic field strength.

The induced voltage $U_{Ind}$ in each coil 6, 6' is thus proportional to the field strength at the location of the coil. Without a metal strand 1 positioned between the coils 6, 6', subtraction of the induced voltages $U_{Ind1}$ in coil 6 and $U_{Ind2}$ in coil 6' yields a differential signal, i.e., a voltage difference $U_{Ind}$, between the coils in the electromagnetic field of the inductors 5 which corresponds to the position of the coils. Under ideal conditions and equal distances $X_1$ and $X_2$, the voltage difference $U_{Ind}$ between the coils 6 and 6' is zero.

If the metal strand 1 is now introduced into the active electromagnetic field between the coils 6, 6', this differential signal $U_{Ind}$ of the coils 6, 6' varies for a fixed position of the coils 6, 6'.

If the metal strand 1 now occupies different positions s between the inductors 5 and the coils 6, 6' arranged in front of the inductors, different differential signals of the coils 6, 6' are obtained as a function of the position s. The position s of the metal strand 1 is obtained from the difference of the locally fixed coils 6, 6' and their arrangement according to the parameters height position of the coils 6, 6', width position B of the coils 6, 6', and distance $X_1$ and $X_2$ of the coils 6, 6' from the inductor 5.

Accordingly, a voltage $U_{Ind1}$ and $U_{Ind2}$ is induced in the coils according to the following equation:

$$U_{Ind1}=-n_1\cdot dPhi/dt\cdot f_1$$

and $$U_{Ind2}=-n_2\cdot dPhi/dt\cdot f_2$$

where $U_{Ind1}$: induced voltage in coil 6

$U_{Ind2}$: induced voltage in coil 6'

$n_1$: number of windings of coil 6

$n_2$: number of windings of coil 6'

$f_1$: factor for coil 6 as a function of the position of the metal strand and the magnetic field strength $f_2$: factor for coil 6' as a function of the position of the metal strand and the magnetic field strength.

The voltage induced in the coils 6, 6' is measured in one section of the measuring device 8. The output side of the section of the measuring device 8 in which this measurement is carried out is connected to a subtractor 9, in which the voltage difference $U_{Ind}$ is determined, i.e., the difference between the induced voltage $U_{Ind1}$ in coil 6 and the induced voltage $U_{Ind2}$ in coil 6'. The output side of the subtractor 9 is connected to a unit in the measuring device 8 in which, starting from the voltage difference $U_{Ind}$, a back computation is carried out to determine the position s of the metal strand 1 relative to the center plane 7 of the guide channel 4. The functional behavior stored in this unit for the position of the metal strand depends on the voltage difference $U_{Ind}$.

The position s of the metal strand 1 is obtained on the basis of the measured voltage difference $U_{Ind}$ according to a function stored in the measuring device 8 by means of feedback of the metal strand 1 located between the coils 6, 6' and of the individual voltages thus induced in the coils as a function of the position of the strip and as a function of the magnetic field. It is thus possible in a simple and accurate way to determine the position s of the metal strand 1 and to utilize it for the automatic position control of the steel strip.

LIST OF REFERENCE SYMBOLS

1 metal strand (steel strip)
2 coating metal
3 coating tank
4 guide channel
5 inductor
6 sensor (coil)
6' sensor (coil)
7 center plane of the guide channel
8 measuring device
9 subtractor
s position of the metal strand
R conveying direction
$H_0$ height of the inductor
Y distance between the inductors
H height position of the coil
L width position of the coil
$X_1$ distance of the coil 6 from the inductor
$X_2$ distance of the coil 6' from the inductor
$U_{Ind1}$ induced voltage in coil 6
$U_{Ind2}$ induced voltage in coil 6'
$U_{Ind}$ voltage difference

The invention claimed is:

1. Device for hot dip coating a metal strand (1), in which the metal strand (1) is passed vertically through a coating tank (3) that contains the molten coating metal (2) and through a guide channel (4) upstream of the coating tank, with at least two inductors (5) installed on both sides of the metal strand (1) in the area of the guide channel (4) for generating an electromagnetic field in order to keep the coating metal (2) in the coating tank (3) and with at least one sensor (6, 6') for determining the position (s) of the metal strand (1) in the area of the guide channel (4), wherein the sensor for determining the position of the metal strand (1) consists of two coils (6, 6'), which are installed, as viewed in the direction of conveyance (R) of the metal strand (1), within the height ($H_0$) of the inductors (5), and between the inductors (5) and the metal strand (1), wherein the coils (6, 6') are the same and are designed as wire windings without a core, wherein the coils (6, 6') have one or more windings, and wherein the wire of the coils (6, 6') is made of copper.

2. Device in accordance with claim 1, wherein the coils (6, 6') and the inductors (5) are arranged symmetrically with respect to the center plane (7) of the guide channel (4).

3. Device in accordance with claim 1, wherein the windings of the coils have a circular, oval or rectangular shape.

4. Device in accordance with claim 1, wherein the coils (6, 6') are connected to a measuring device (8) for measuring the voltages ($U_{Ind1}$, $U_{Ind2}$ induced in the coils (6, 6').

5. Device in accordance with claim 4, wherein the measuring device (8) is designed for the high-impedance measurement of the voltages ($U_{Ind1}$, $U_{Ind2}$) induced in the coils (6, 6').

6. Device in accordance with claim 4, wherein the measuring device (8) has a subtractor (9), with which the difference ($U_{Ind}$) of the two voltages ($U_{Ind1}$, $U_{Ind2}$) induced in the coils (6, 6') can be determined.

7. Device in accordance with claim 1, wherein several pairs of coils (6, 6') are installed, as viewed in the direction of conveyance (R) of the metal strand (1), within the height ($H_0$) of the inductors (5) and between the inductors (5) and the metal strand (1).

8. Method for hot dip coating a metal strand (1), in which the metal strand (1) is passed vertically through a coating tank (3) that contains the molten coating metal (2) and through a guide channel (4) upstream of the coating tank; in which an electromagnetic field is generated by at least two inductors (5) installed on both sides of the metal strand (1) in the area of the guide channel (4) in order to keep the coating metal (2) in the coating tank (3); and in which the position (s) of the metal strand (1) in the area of the guide channel (4) is determined with at least one sensor (6, 6'), wherein to determine the position of the metal strand (1), two coils (6, 6') are provided, which are installed, as viewed in the direction of conveyance (R) of the metal strand (1), within the height ($H_0$) of the inductors (5), and between the inductors (5) and the metal strand (1), and the voltages ($U_{Ind1}$, $U_{Ind2}$) induced in the coils (6, 6') are measured, the difference between the measured voltages is taken, and the resulting value is used to derive an indicator for the position of the metal strand (1).

* * * * *